US011158215B2

(12) United States Patent
Martin et al.

(10) Patent No.: US 11,158,215 B2
(45) Date of Patent: Oct. 26, 2021

(54) INTERCHANGEABLE SIGN ASSEMBLY

(71) Applicants: Matthew Martin, Elma, NY (US); Dawn M. Gnojek, Elma, NY (US); Joseph E. S. Gnojek, Elma, NY (US)

(72) Inventors: Matthew Martin, Elma, NY (US); Dawn M. Gnojek, Elma, NY (US); Joseph E. S. Gnojek, Elma, NY (US)

( * ) Notice: Subject to any disclaimer, the term of this patent is extended or adjusted under 35 U.S.C. 154(b) by 0 days.

(21) Appl. No.: 17/124,629

(22) Filed: Dec. 17, 2020

(65) Prior Publication Data

US 2021/0192980 A1 Jun. 24, 2021

Related U.S. Application Data

(60) Provisional application No. 62/951,204, filed on Dec. 20, 2019.

(51) Int. Cl.
*G09F 7/22* (2006.01)

(52) U.S. Cl.
CPC ..... *G09F 7/22* (2013.01)

(58) Field of Classification Search
CPC .. G09F 7/22; B42D 5/04; B42D 5/048; B42D 5/046; B42F 17/16; B42F 17/346; B43L 1/04
See application file for complete search history.

(56) References Cited

U.S. PATENT DOCUMENTS 588,631 A * 8/1897 Brown ..... B42D 5/043 40/120
1,107,251 A * 8/1914 Birdsell ..... B42D 5/046 40/119
1,159,801 A * 11/1915 Rosenzweig ..... B42F 17/00 40/401
1,907,261 A * 5/1933 Shedd ..... G09D 3/04 40/119
2,324,259 A * 7/1943 Havel ..... B42F 13/0093 402/8
D348,481 S * 7/1994 Grant ..... D19/21
7,260,904 B1 * 8/2007 Boisseau ..... G09D 3/00 40/107

FOREIGN PATENT DOCUMENTS

JP 56113856 * 9/1981
JP 407232488 A * 9/1995

* cited by examiner

*Primary Examiner* — Cassandra Davis
(74) *Attorney, Agent, or Firm* — Stadler IP Law PLLC

(57) ABSTRACT

A sign assembly including a flip placard assembly, a placard support assembly, a flip assembly, hinges, flip placards, and placard supports such that the flip placards can be interchanged. A clear cover connected to a bottom placard support creating a compartment for additional messaging. A method of quickly interchanging flip placards for use in a nuclear facility or hazardous environment.

5 Claims, 3 Drawing Sheets

INTERCHANGEABLE SIGN ASSEMBLY

CROSS-REFERENCE TO RELATED APPLICATION

This application claims priority to U.S. Provisional Patent Application having Ser. No. 62/951,204, filed on Dec. 20, 2019, the entire disclosure of which are hereby incorporated herein by reference.

FIELD OF INVENTION

This invention is directed to a sign for use in hazardous environments. More particularly, this invention is directed to an interchangeable sign assembly and method for interchanging the signs in a changing hazardous environment.

BACKGROUND OF INVENTION

In nuclear facilities and other hazardous environments, signs are often used to indicate to individuals what level of protective gear or caution they need to adhere to before entering a particular area of the facility. For example, there may be a sign that reads "CAUTION HIGH RADIATION AREA" to indicate that personnel must be briefed about the conditions before entering said room.

Another sign may read "STOP" to indicate that no one is to enter that area of the facility. Other signs may be used to indicate that the area of the facility is safe.

In practice, an individual must go to the sign and physically take the sign off and then replace it with a new sign when the circumstances of that area of the facility changes. This practice is tedious, time-consuming, inefficient, and is not cost-effective.

Thus, it would be beneficial to find a solution that provides a quick and efficient means for changing the message on the sign for individuals entering an area of the facility that has varying hazard levels.

SUMMARY OF THE INVENTION

Accordingly, it is the subject of this invention to provide interchangeable signs, an interchangeable sign assembly, and a method for quickly and efficiently interchanging the signs. In particular, the present invention provides a placards or signs that include all of the necessary signs for the nuclear facility or other hazardous environment. From there, the signs can be quickly, easily, and efficiently changed by flipping the signs up or down to meet the condition of the area being entered.

An interchangeable placard assembly is disclosed comprising: a flip placard assembly including at least one top flip placard connected to at least one bottom flip placard such that the at least one top flip placard and at least one bottom flip placard can be raised or lowered; a placard support assembly for supporting the flip placard assembly wherein the placard support assembly includes a bottom placard support connected to a middle placard support connected to a top support placard; and a clear cover connected to the bottom placard support, wherein the clear cover is connected to the bottom placard support by a top horizontal adhesive strip and a bottom horizontal adhesive strip.

DETAILED DESCRIPTION OF THE INVENTION

Components:
Sign assembly—10
Flip placard assembly—15
Flip assembly—20
Hinges—25
Top flip placard—30
Bottom flip placard—35
Bottom placard support—40
Middle placard support—45
Top placard support—50
Placard support assembly—55
Attachment tab—60
Left bottom cutout portion—65*a*
Left top cutout portion—65*b*
Right bottom cutout portion—70*a*
Right top cutout portion—70*b*
Clear cover—75
Adhesive strip—80
Compartment—85

Figure 1:
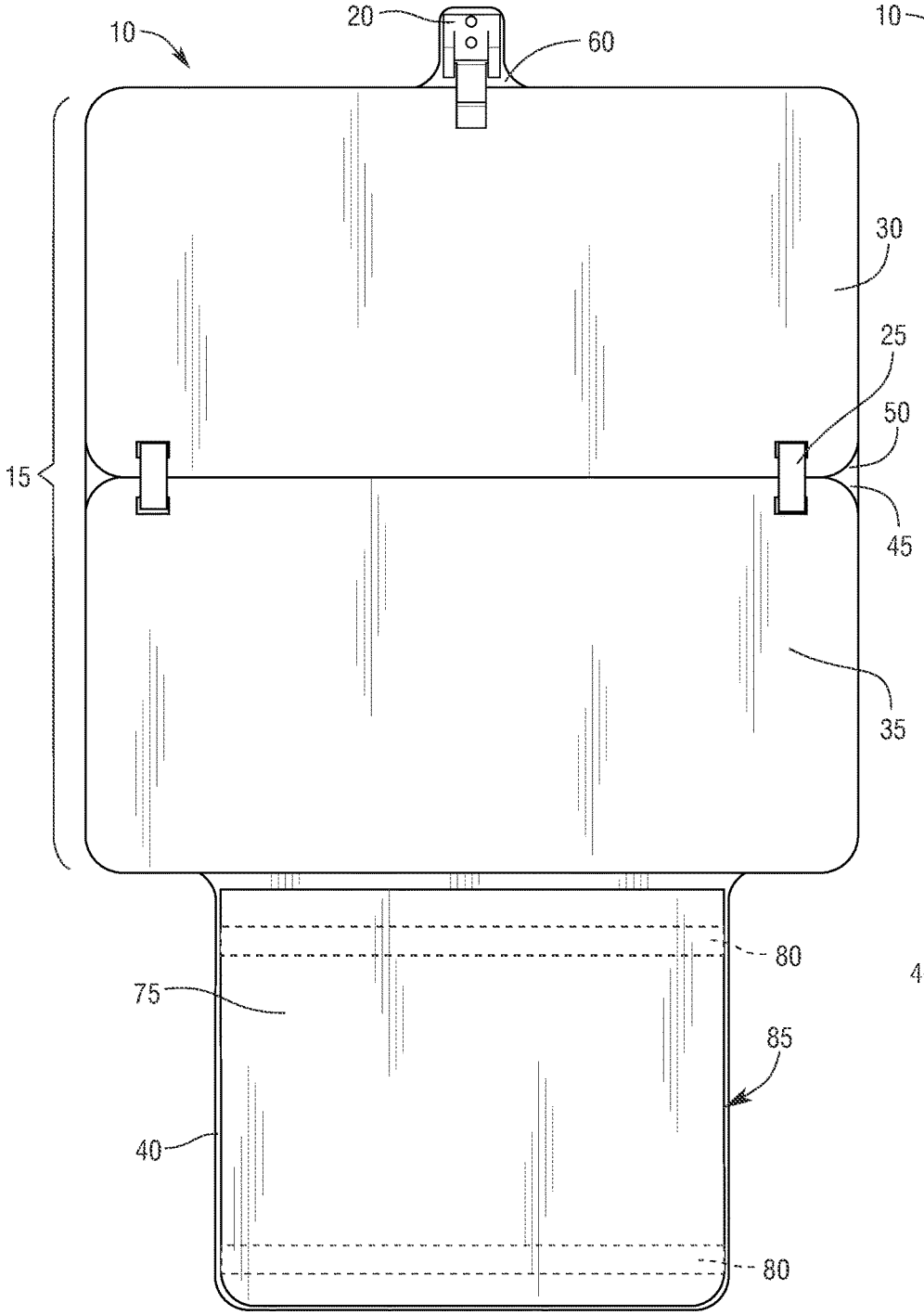
FIG. 1 depicts a front view of a sign assembly of the present invention.
Figure 2:
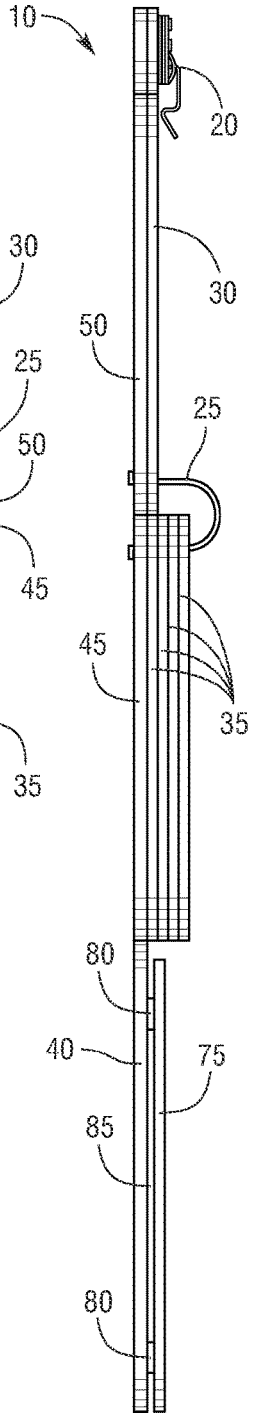
FIG. 2 depicts a side view of the sign assembly of the present invention.
Figure 3:
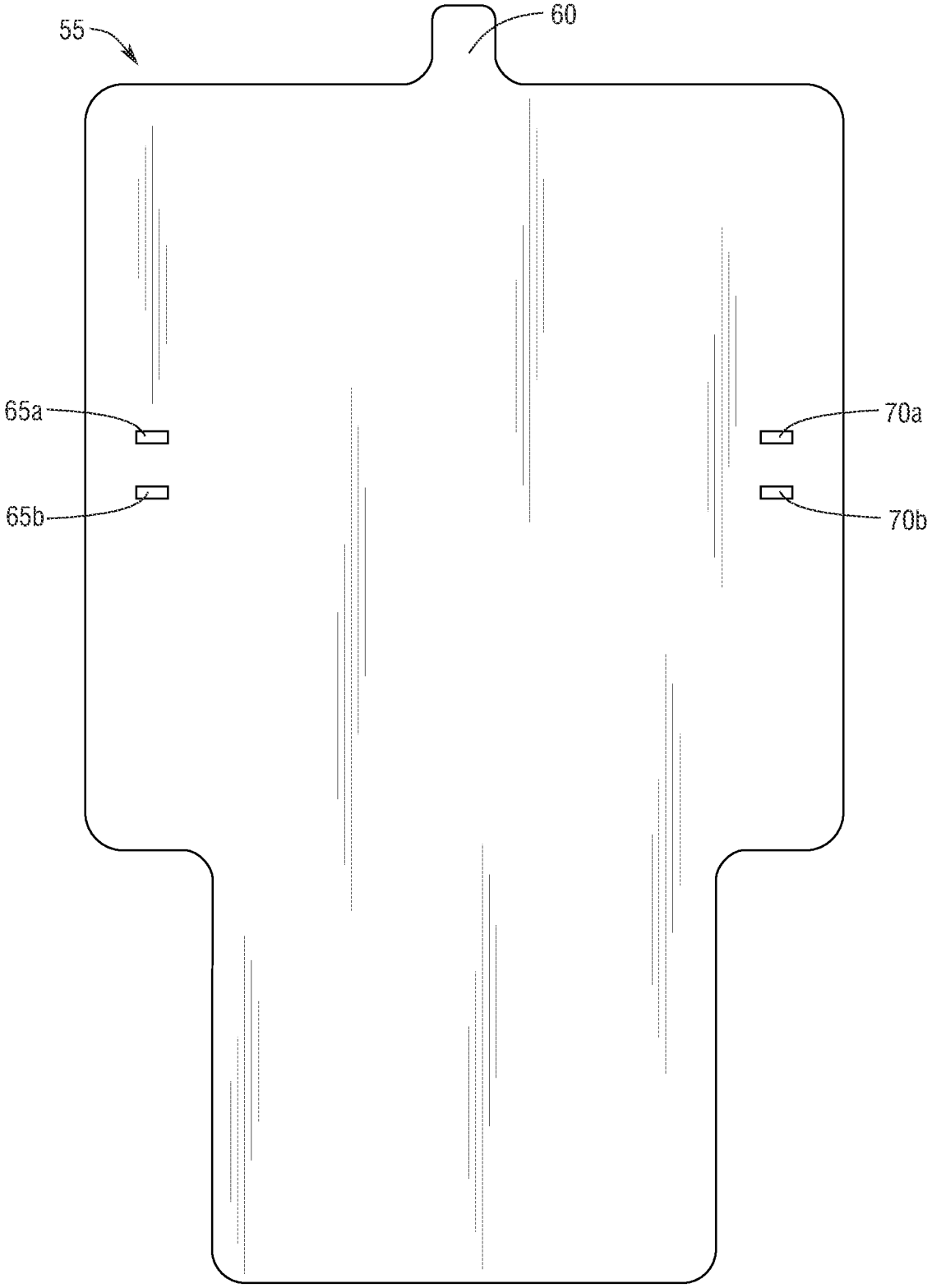
FIG. 3 depicts a front view of a placard support assembly of the present invention.

As can be seen in FIG. 1, a sign assembly 10 is disclosed. Sign assembly 10 includes flip placard assembly 15, flip assembly 20, hinges 25, and placard support assembly 55 (FIG. 3). Flip placard assembly 15 includes top and bottom flip placards 30, 35. Placard support assembly 55 includes bottom, middle, and top placard supports 40, 45, and 50 (FIG. 2). Bottom placard support 40 also includes a clear cover 75. Bottom placard support 40 is connected to clear cover 40 by adhesive strips 80, which creates compartment 85.

FIG. 2 depicts a side view of sign assembly 10 including top placard support 50, middle support placard 45, bottom placard 40, connected to clear cover 75 by adhesive strips 80 and containing compartment 85. Also shown are bottom flip placards 35 connected to middle placard support 45 by way of hinges 25. Top flip placard 30 is connected to top placard support 50 by hinges 25 and is secured in the top flip placard position by flip assembly 20.

FIG. 3 shows placard support assembly 55 having tab 60 and left bottom cutout portion 65*a*, left top cutout portion 65*b*, right bottom cutout portion 70*a*, and right top cutout portion 70*b*.

Figure 4:
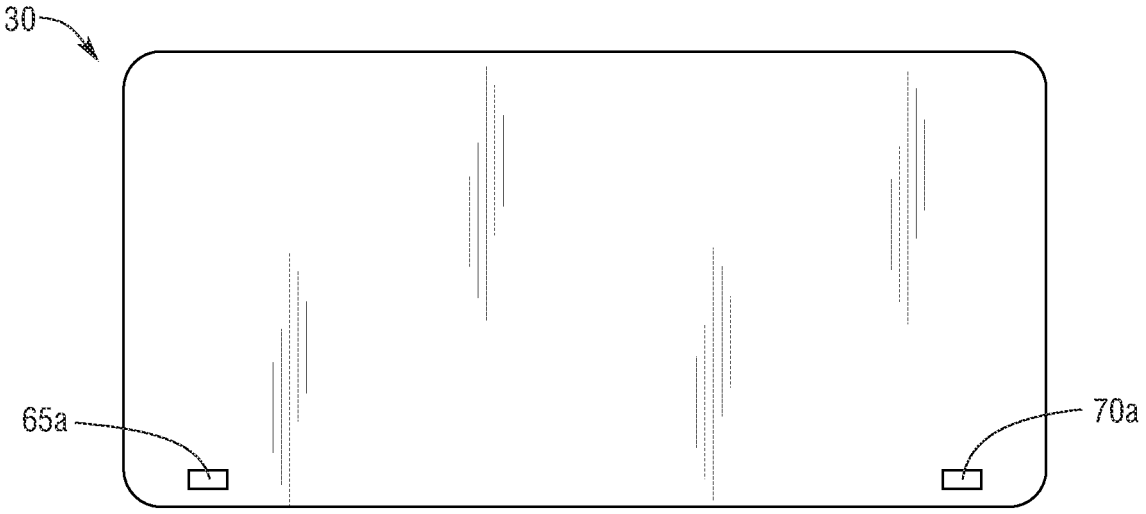
FIG. 4 depicts a front view of a flip placard of the present invention.

FIG. 4 illustrates top flip placard 30 having left bottom cutout portion 65*a* and right bottom cutout portion 70*a*.

Figure 5:
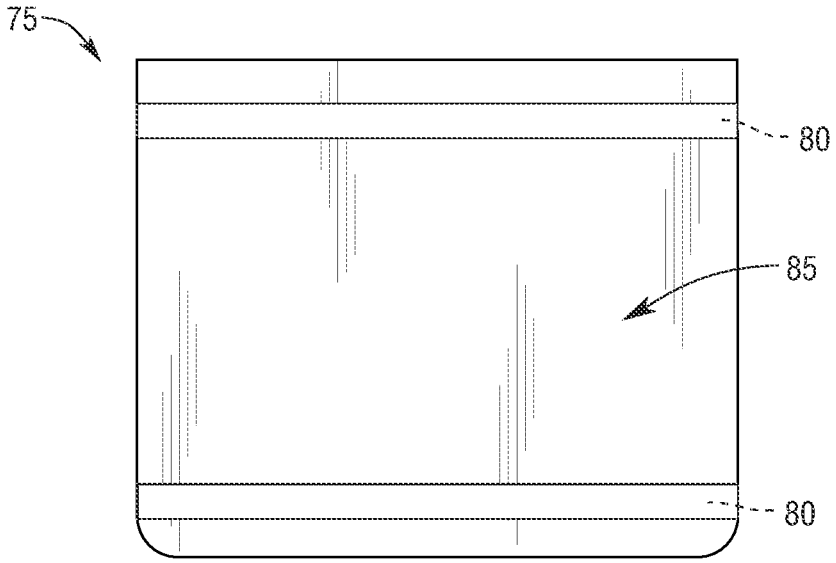
FIG. 5 depicts a rear view of a clear cover of the present invention.

FIG. 5 shows a rear view of clear cover 75 having adhesive strips 80 on the top and bottom, thereby defining compartment 85 when connected to bottom placard support 40.

Figure 6A:
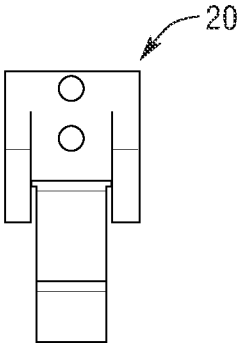
FIG. 6A depicts a front view of a flip assembly of the present invention.
Figure 6B:
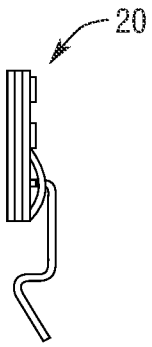
FIG. 6B depicts a side view of a flip assembly of the present invention.

FIGS. 6A and 6B show a front view of flip assembly 20 and a side view of flip assembly 20, respectively. As can be seen in FIG. 6B, when the lever of flip assembly 20 is in a down position, top flip placard 30 will be secured in place.

Figure 7A:
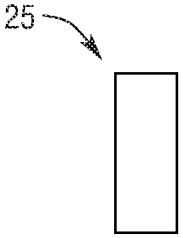
FIG. 7A depicts a back view of a hinge of the present invention.
Figure 7B:
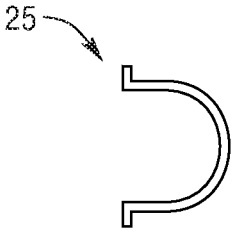
FIG. 7B depicts a side view of a hinge of the present invention.

FIG. 7A depicts the back of the hinge, which holds the front of the hinge, as depicted in FIG. 7B, in place. In one embodiment, the back of hinge 25 is tape or adhesive. The hinges rotatably hold the top and bottom flip placards 30, 35.

In use, top flip placard 30 and bottom flip placard 35 of flip placard assembly 15 both have indicia to caution people that are about to enter a room with changing levels of hazard in it. Bottom flip placard 35 may have indicia indicating the particular warning level. At a facility, a user may rotate the flip placards up or down to change the messaging. When in the down position, the flip placard is bottom flip placard 35, but when rotated around the hinge upwards, it becomes top flip placard 30. The first side of bottom flip placard 35 will have certain indicia on it and when it is flipped or rotated upwards, the second side will have different indicia on it and in this position, it becomes top flip placard 30. In this way, when the level of hazard inside a particular part of a facility changes, the flip placards can be easily rotated upwards or downwards to let people know what safety precautions must be taken prior to entering.

The above can be seen in FIG. 2, which shows a side view of sign assembly 10. Placard support assembly 55 (FIG. 3) includes three placard supports, top placard support, middle placard support 45, and bottom placard support 40. In one embodiment, placard support assembly 55 is one continuous piece. Top placard support 50 includes tab 60, which is connected to flip assembly 20. Flip assembly 20 holds top flip placard 30 in place. Bottom flip placards 35 are capable of being rotated about hinge 25 into a top flip placard 30 position. Bottom placard support 40 includes a clear cover 75, which includes adhesive strip 80 at the top and bottom of clear cover 75 thereby connecting clear cover 74 to bottom placard support 40 and creating compartment 85, which allows a user to insert paper containing indicia that provides an additional warning to those entering the facility of the danger level. In a preferred embodiment, adhesive strips 80 are placed horizontally. In another embodiment, there may be additional adhesive strips 80 to create more compartments. Preferably, there are four adhesive strips 80 that create three compartments 85.

In a preferred embodiment, the flip assembly 20 includes at least one 81-clip made of stainless steel to hold the flip placards in place from flipping on their own. The lever of the 81-clip of flip assembly 20 is capable of rotating upwards to allow the flip placards to be moved up or down depending on which message is needed. The lever of 81-clip of flip assembly 20 can then be rotated downward to lock the flip placard in place. Different shapes for the flip placards may indicate different warning levels with the traditional octagon being used for the "STOP" sign warning.

The sign assembly 10 of FIGS. 1-2 may be attached to the wall by any suitable means. In one embodiment, the placard support assembly 55 has holes (not shown) drilled through it where screws or other means may be used to attach the sign assembly 10 to a wall or door. In one embodiment, the sign assembly includes 30 lb pull force self adhesive magnets for door mounting (not shown).

In FIGS. 1-2, and 7A and 7B, hinges 25 may be any suitable hinge. In one embodiment, hinges 25 are spring clips that are approximately 0.018" thick×0.600" wide and are made out of 1050-1074 annealed spring steel. Alternatively, hinges 25 may be ⅛ half round stock hinges connected with tape on the back In another embodiment, the support placards 40, 45, and 50 are made of 12 GA (0.080") (A1 5052 H32 grade) aluminum. In another embodiment, the flip placards are made of 0.062" poly plastic.

In one embodiment, a placard support assembly 55 is provided and preferably has a thickness of ⅛" and is made of aluminum. The bottom, middle, top placard supports 40, 45, 50, may be any size or shape, but in a preferred embodiment, the placard supports are 12" by 6".

In one embodiment, a placard support assembly 55 has a width of 12" at the top and 8" at the bottom and is 19" in length, wherein the bottom width narrows at 6.854" from the bottom. Thus, bottom placard support 50 is narrower than top placard support 40 and middle placard support 45. In this embodiment, bottom placard support 40, middle placard support 45, and top placard support 50, are combined into one placard support rather than being individual placard supports.

The placard support assembly 55 also includes four cutout portions: left bottom cutout portion 65*a*, left top cutout portion 65*b*, right bottom cutout portion 70*a*, and right top cutout 70*b* portion. These cutout portions are for receiving hinge 25 to connect the placard support assembly 55 to top flip placard 30 and bottom flip placard 35. Theses cutout portions are also present in the top and bottom flip placards 30, 35.

In one embodiment, as shown in FIGS. 1-2, and 5, the bottom placard support 40 includes a clear cover 75 that allows additional signage and information to be inserted between the clear cover 75 and the bottom placard support 40. In one embodiment, the clear cover 75 may be made of plastic or any suitably clear material. The clear cover 75 may be connected to the bottom placard support 40 by tape or glue or any other adhesive 80. The tape or glue or other adhesive may function to create smaller areas or compartments 85 to allow for additional messages to be inserted into the compartment.

The placard support assembly 55 can be made by using a CNC plasma cutting machine. In one embodiment, the aluminum may be powder coated in order to provide for a longer lifetime. In another embodiment, the bottom placard support 40 is not included.

UV graphic 3D printing is used in order to create the particular warning on the flip placards. In another embodiment, the top placard support 50 includes indicia and in this case it serves the same function as the top flip placard 30.

The flip placards are attached to a placard support assembly 55 by hinges 25. In one embodiment, the flip placards are made of polycarbonate plastic and include indicia.

As can be imagined, while the description of the interchangeable sign and method for interchanging the signs has been described for use in a nuclear facility, the sign may be useful at any hazardous environment or facility. For example, the interchangeable sign may be used at any DOE facility, at hospitals or other medical facilities, nanotechnology fabrication facilities, processing plans, milling plants, laundering facilities, prescreening facilities, or decontamination facilities.

EXAMPLES

Example 1

In one illustrative example the sign assembly 10 includes several top flip placards and bottom placards. In this example, the sign assembly 10 is used in a nuclear facility. Top placard support 50 has written indicia thereon. The written indicia reads GRAVE DANGER and bottom flip placard 35 has written indicia reading VERY HIGH RADIATION AREA RADIATION PROTECTION ESCORT AND BRIEFING REQUIRED FOR ENTRY. The bottom flip placard 35 can be rotated around hinges 25 and flipped upward such that bottom flip placard 35 becomes top flip placard 30 and has written indicia reading CAUTION and the next visible bottom flip placard 35 has written indicia reading LOCKED HIGH RADIATION AREA. When this bottom flip placard 35 is flipped up into position as top flip placard 30, the written indicia of top flip placard 30 reads CAUTION with the newly visible bottom flip placard 35 reading HIGH RADIATION AREA. On the next set of flip placards, the top flip placard 30 reads caution and the bottom flip placard 35 reads RADIATION AREA. In this example, there are a total of three flip placards.

It will be appreciated by those skilled in the art that while the interchangeable sign assembly and method for changing signs has been described in detail herein, the invention is not necessarily so limited and other examples, embodiments, uses, modifications, and departures from the embodiments, examples, uses, and modifications may be made without departing from the process and all such embodiments are intended to be within the scope and spirit of the appended claims.

What is claimed is:

1. An interchangeable placard assembly comprising:

a one piece placard support assembly for supporting a flip placard assembly wherein the placard support assembly includes a bottom placard support connected to a middle placard support connected to a top placard support and two hinges the flip placard assembly including at least one top flip placard connected to at least one bottom flip placard such that the at least one top flip placard and at least one bottom flip placard can be raised or lowered and wherein the at least one top flip placard has two cutouts at the bottom for receiving the two hinges and the at least one bottom flip placard has two cutouts at the top for receiving the two hinges that connect the at least one top flip placard and the at least one bottom flip placard and wherein the top placard support has an attachment tab at the top that is connected to the flip placard assembly that is capable of holding the at least one top flip placard in place;

wherein the middle placard support and the top placard support each has two cutout portions at top and bottom portion of the respective support placards for receiving the two hinges that connect the at least one top flip placard and at least one bottom flip placard; and a clear cover connected to the bottom placard support by a top horizontal adhesive strip and a bottom horizontal adhesive strip.

2. The interchangeable placard assembly of claim 1, the top flip placard and at least one bottom flip placard each has one of the two cutout portion on the right and a second of the two cutout portion on the left; wherein the middle placard support, and the top support placard has two cutout portions.

3. The interchangeable placard assembly of claim 1 wherein the top placard support and middle placard support are the same size and the bottom placard support and clear cover are narrower than the top and middle placard supports.

4. An interchangeable placard assembly comprising:

a one piece placard support assembly supporting a flip placard assembly wherein the placard support assembly includes a bottom placard support connected to a middle placard support connected to a top placard support; and a hinge the flip placard assembly including at least one top flip placard connected to at least one bottom flip placard such that the at least one top flip placard and at least one bottom flip placard can be raised or lowered; and wherein the middle placard support and top placard support each has a cutout portion at the top and bottom portion of the respective support placards for receiving the hinge that connects the at least one top flip placard and the at least one bottom flip placard;

wherein the at least one top flip placard has a cutout at the bottom for receiving a hinge and the at least one bottom flip placard has a cutout at the top for receiving the hinge that connect the at least one top flip placard and the at least one bottom flip placard and wherein the top placard support has an attachment tab at the top that is connected to the flip placard assembly that is capable of holding the at least one top flip placard in place;

a clear cover connected to the bottom placard support by a top horizontal adhesive strip and a bottom horizontal adhesive strip and wherein there is at least one middle horizontal adhesive strip between the top horizontal adhesive strip and bottom horizontal adhesive strip.

5. The interchangeable placard assembly of claim 4 wherein the top placard support and middle placard support are the same size and the bottom placard support and clear cover are narrower than the top and middle placard supports.

* * * * *